United States Patent [19]

Kuznetz

[11] 4,341,219

[45] Jul. 27, 1982

[54] SUPPORT BRASSIERE

[76] Inventor: Lawrence Kuznetz, 2336 Crows Nest La., League City, Tex. 77573

[21] Appl. No.: 172,226

[22] Filed: Jul. 23, 1980

[51] Int. Cl.[3] ..... A41C 3/00

[52] U.S. Cl. ..... 128/498

[58] Field of Search ..... 128/488, 510, 425, 429, 128/486, 488, 498

[56] References Cited

U.S. PATENT DOCUMENTS

| | | | |
|---|---|---|---|
| 52,400 | 2/1866 | Durand | 128/520 |
| 1,400,295 | 12/1921 | Kops | 128/429 |
| 1,575,989 | 3/1926 | Haven | 128/482 |

*Primary Examiner*—Doris L. Troutman

[57] ABSTRACT

A support brassiere having an anterior section which is conformable to the breasts and is elastically stretchable in the horizontal direction but not substantially stretchable in the vertical direction connected to a dorsal section and a shoulder support section preferably having the same stretch characteristics. The anterior section is provided with uplifting and separating straps located at the approximate cleavage line and extending downwardly and sidewardly to conform to the underside of the respective breasts and extending downwardly to be secured at the dorsal section.

8 Claims, 2 Drawing Figures

SUPPORT BRASSIERE

FIELD OF INVENTION

Figure 1:
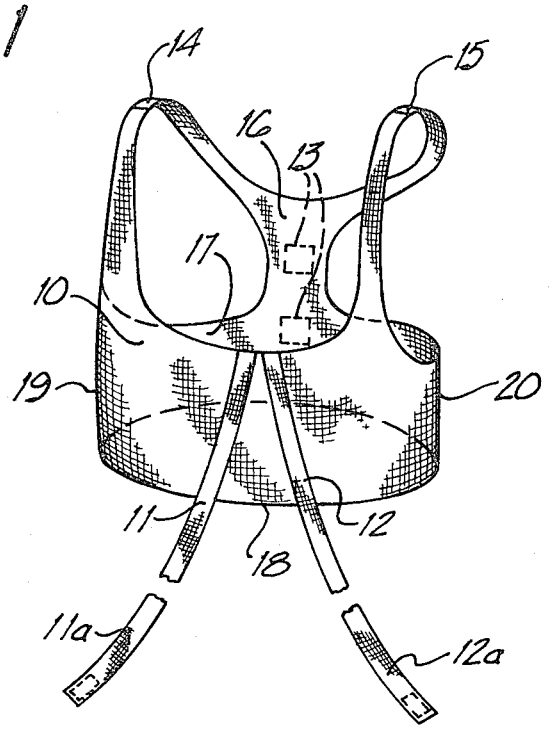

This invention relates to athletic equipment in general, and in particular to a lady's support brassiere suitable for use during exercise of athletic activities such as jogging.

BACKGROUND OF THE INVENTION

In recent years, participation by women in sports and athletics has been increasing steadily. This is no doubt due, in part at least, to the growing awareness of the need and desirability for exercise in one's daily life. Increased participation by women in jogging, basketball, marathon running, tennis, racquetball and the like has been noted.

During sustained physical activity, especially during those activities that involve constant moving, jumping or running on a sustained basis, stresses are put on the body which may result in a variety of problems. Probably the most serious and discomforting of these problems are the abrasions and chafing that can occur at the interface of clothing with the body. The problem of heat removal during exercise is also a matter which should be dealt with.

Women encounter an additional problem when they engage in sustained physical activity requiring a lot of running. This problem occurs as a result of the bounce of the breasts caused by the activity and this can lead to a variety of discomforts including long term damage to tissue and muscle. Bounce in and of itself may be more or less discomforting to a woman depending on bust size and length of running time. It is generally felt however that bounce is an uncomfortable, if not painful, condition and should be eliminated. More than that however, is the condition that bounce may lead to. For example, in a relatively large busted woman, bounce can cause the breasts to rub against each other if the garment she is wearing does not keep the breasts separated. This could lead to chafing and abrasions and if the activity is sufficiently sustained such as in long distance jogging, bleeding may occur. A similar result from bounce may occur if the lower part or underside of the breast rubs either against the immediately adjacent skin of the chest wall or against the garment she is wearing.

In addition to the above areas of discomfort, the mere presence of a breast support garment causes heat build up and perspiration which in themselves are quite uncomfortable.

It can be seen therefore that a brassiere which eliminates or substantially reduces the potential for the conditions described above to occur, would be a desirable product.

THE PRIOR ART

To the extent known to us, there is no athletic support brassiere available which satisfactorily eliminates or substantially reduces the conditions described above. Women generally wear the lingerie type of brassiere during their exercise and this is hardly suitable. Thus, although there are brassieres described in the art which tend to uplift and separate the breasts, during periods of little or not activity, their construction is such as to promote aesthetics. They are unsuitable for performing under conditions of stress. To our knowledge, there has not been previously described a brassiere wherein bounce and its attendant problems are eliminated or substantially reduced during periods of sustained jumping or running.

DESCRIPTION OF THE INVENTION

There is now provided a brassiere having a construction which simultaneously uplifts the breasts, separates them from one another and compresses them relatively tightly. With respect to conventional brassieres, the brassiere of the present invention has relatively ill defined cups, it being much more preferred to provide a surface conformable to the breasts. This reduces the likelihood of bounce in that the conformable surface provides positive forming fit and compression action against the breasts themselves. In general, the brassiere of the present invention is a unitary design having an anterior breast engaging section, a dorsal section connected to the anterior section, a shoulder support section connecting with at least the anterior section, wherein there is present in the anterior section, at least one sharp-like member for each breast commencing at approximately the cleavage line and extending in a generally downward and sideward direction following in general the line of the underside of the respective breasts and then extending rearwardly to meet the dorsal section, said straps being adapted to be adjustably secured at the dorsal section.

A BRIEF DESCRIPTION OF THE DRAWING

The accompanying drawings will illustrate specific embodiments of the invention. FIG. 1 shows a frontal view of the article of the invention. The anterior section 10, has associated with it two straps 11 and 12, preferably attached along its vertical stretch to the anterior section and running generally downwardly and sidewardly conforming to the line of the underside of the breast. The straps are preferably an inch or so wide so as to engage the underside of the breast and a portion of the immediately adjacent chest wall for optimum comfort. They are (as is the anterior portion itself) made from a material having stretch characteristics, preferably in the longitudinal direction only such as Spandex. Straps 11 & 12, after following the contour of the breasts extend rearwardly toward the dorsal section preferably as loose straps **11*a* & 12*a*, there to be available for wrapping around the body of the wearer and secured at the dorsal section. The straps are positioned in such a way that the horizontal portion thereof aids in preventing the bottom of the breast from resting on the chest wall, thereby minimizing the risk of trauma and abrasion at that interface and contributing to the comfort of the wearer. In practice, 11*a* & 12*a* are pulled tightly by the wearer or an attendant and secured by known means. A VELCRO fitting on each end of the straps 11*a* & 12*a* or on the dorsal section itself 13 (see FIG. 2) will be suitable. Optionally, the dorsal section can be interrupted by connectors rather than being in the form of one continuous circular piece with the anterior section. Continuous construction is preferred however. The action of the straps 11, 11*a*, 12 and 12*a*** provide predominantly separation of the breasts and the uplift necessary for juxtaposing the breasts in a suitable, comfortable contour to be compressed by the action of the anterior section. In this regard it should be noted that the stretch characteristics of the material of construction for the anterior section and the general "fit" of the brassiere should be such as to provide compression to the wearer. While one size to fit all wound be possible, it is much preferred to have three sizes available for the general build characteristics of the small, medium and large female, the size being somewhat smaller than the build characteristics to provide the needed compression.

Figure 2:
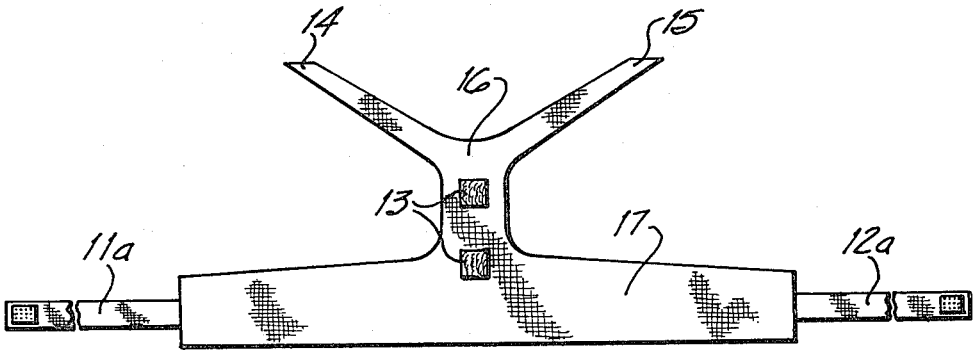

The brassiere shown in FIGS. 1 & 2 has a "Y" section 16 connecting the anterior section 10 with the dorsal section 17. This is the preferred mode of construction. However, if desired, the "Y" section 16 may be separate from the dorsal section 17 in which case it will be supported by the neck of the wearer.

Straps 14 and 15 are shown as being adjustable such as with buckles or VELCRO being preferred, but they may as suitably be unitary in design as in a pullover fashion.

A characteristic of the article of the invention is provided by the preferred material of construction. As indicated previously it is preferred that at least the anterior section be stretchable in one direction, namely the horizontal but not substantially stretchable in the vertical direction. This characteristic provides compression of the breasts in a horizontal direction, but because of the relative rigidity in the vertical direction, gives excellent protection against bounce. The expansibility of straps 11 and 12 in the longitudinal direction does not compromise this effect to any great extent especially if they are attached to the anterior section (as opposed to connecting contiguous portions) since in the case of attachment the limiting force will be that of the resistance to stretch that the anterior section has in the vertical direction. As noted previously, a preferred material of construction is Spandex, a well-known elastomeric fiber comprised of mainly a segmented polyurethane. As used herein, the word "stretch" connotes elasticity.

Another feature of the brassiere of the present invention is provided by the "Y" shaped section 16. The presence of this configuration permits the positioning of straps 14 and 15 higher up on the trapezius and distal to the deltoid muscles of the wearer. Since more motion during running comes from the area proximal to the deltoid, with relatively little motion coming from the area of the high trapezius, the described configuration substantially reduces discomfort due to abrasion in that area. "Y" section 16 may in fact be dispensed with, and straps 14 & 15 connected directly to the dorsal section 17, although this is not preferred.

Another feature of the article of this invention is provided in a preferred embodiment wherein the interface of the lower part of the anterior section 18 and the body extends below the breast line and is somewhat loose as compared to the tightening effect of the anterior section against the breasts. This looseness acts as a "spoiler" and scoops air while the wearer is running, thus permitting a flow of air through the underside of the brassiere with consequent cooling. In a preferred mode, means are provided such as (perforations 19 & 20) to facilitate the flow of air out of the brassiere.

The article of the invention provides great comfort during both static and active periods. This can be enhanced by lining the inside of the article with a cotton liner. A nylon knit exterior liner will provide a good aesthetic quality and also facilitate the removal of heat and perspiration from the inside of the brassiere.

The present article provides:

(1) separation and uplift of the breasts, (2) compression in the horizontal direction holding the breasts secure, (3) support in the vertical direction minimizing bounce, (4) good heat and perspiration removal.

It achieves these at least in part through the use of adjustable straps 11*a* & 12*a* connected to straps 11 and 12 attached to the anterior section and extending downwardly and sidewardly in the general shape of the breast said anterior portion being conformable to the breast and stretchable in the horizontal direction but relatively not stretchable in the vertical direction.

VELCRO® is a registered trademark of Velcro Inc., Manchester, N.H. applied to cloth and material fasteners.

What is claimed is:

1. A support brassiere comprising in combination (a) an anterior breast engaging section conformable to the shape of the breast and being stretchable in the horizontal direction but not substantially stretchable in the vertical direction, connected to each of (b) a dorsal section and (c) a shoulder support section which is not substantially stretchable in the vertical direction.

(d) said anterior section having strap means extending downwardly and sidewardly for each breast respectively and having an extended section of sufficient length to be secured at the dorsal section for separating and uplifting the breasts.

2. The support brassiere of claim 1 wherein the dorsal section is connected to the shoulder support section via a "Y" shaped connector.

3. The support brassiere of claim 2 wherein the shoulder support has connector means for connection to the anterior section.

4. The support brassiere of claim 3 wherein the dorsal section is stretchable in the horizontal direction but not substantially stretchable in the vertical direction.

5. The support brassiere of claim 4 wherein said strap means are located at their upper end at approximately the cleavage line and extend downwardly and sidewardly following the general contour of the compressed breast at the underside thereof.

6. The support brassiere of claim 5 wherein said strap means is stretchable along its length.

7. The support brassiere of claim 6 wherein said extended sections and said dorsal section are equipped with fastening means adapted to permit securing said sections at the dorsal section.

8. The support brassiere of claim 7 wherein the anterior section, the dorsal section and the shoulder section are of a spandex type material.

* * * * *